US010737497B2

(12) United States Patent
Goda

(10) Patent No.: US 10,737,497 B2
(45) Date of Patent: Aug. 11, 2020

(54) WIPE UNIT AND INKJET RECORDING DEVICE INCLUDING SAME

(71) Applicant: KYOCERA Document Solutions Inc., Osaka (JP)

(72) Inventor: Mitsuhiro Goda, Osaka (JP)

(73) Assignee: KYOCERA Document Solutions, Inc., Osaka (JP)

( * ) Notice: Subject to any disclaimer, the term of this patent is extended or adjusted under 35 U.S.C. 154(b) by 0 days.

(21) Appl. No.: 16/418,570

(22) Filed: May 21, 2019

(65) Prior Publication Data

US 2019/0366720 A1 Dec. 5, 2019

(30) Foreign Application Priority Data

Jun. 4, 2018 (JP) ..... 2018-107105

(51) Int. Cl.
*B41J 2/165* (2006.01)

(52) U.S. Cl.
CPC ..... *B41J 2/16547* (2013.01)

(58) Field of Classification Search
CPC ..... B41J 2/16547; B41J 2/16538; B41J 2/16508; B41J 2/16585; B41J 2/16544; B41J 2/16535
See application file for complete search history.

(56) References Cited

U.S. PATENT DOCUMENTS 4,527,479 A * 7/1985 Dahlgren ..... B41F 31/20 101/148
5,953,026 A * 9/1999 Yoshino ..... B41J 2/16508 347/36

FOREIGN PATENT DOCUMENTS

JP 2014-65261 A 4/2014

* cited by examiner

*Primary Examiner* — Sharon A. Polk
(74) *Attorney, Agent, or Firm* — Stein IP, LLC

(57) ABSTRACT

A wipe unit of the present disclosure includes a wiper, a wiper carriage, a wiper fixing member and a recovery tray. The recovery tray is arranged below the wiper, and includes a tray surface that recovers the ink wiped off with the wiper. The tray surface is inclined with respect to a horizontal plane, and makes the recovered ink flow in a predetermined direction so as to collect the recovered ink. The wiping portion is formed with the wiper and the wiper fixing member, and the wiping portion includes an ink drop portion which drops the ink wiped off with the wiper to the tray surface. The ink drop portion is formed such that the length thereof in a width direction orthogonal to the wiping direction is reduced as the ink drop portion is extended downward.

9 Claims, 13 Drawing Sheets

WIPE UNIT AND INKJET RECORDING DEVICE INCLUDING SAME

INCORPORATION BY REFERENCE

This application is based upon and claims the benefit of priority from the corresponding Japanese Patent Application No. 2018-107105 filed on Jun. 4, 2018, the entire contents of which are incorporated herein by reference.

BACKGROUND

The present disclosure relates to a wipe unit which cleans a recording head that discharges an ink to a recording medium such as a sheet and an inkjet recording device which includes such a wipe unit.

Since an inkjet recording device which discharges an ink to form an image can form a high-definition image, inkjet recording devices are widely used as recording devices such as a facsimile machine, a copying machine and a printer.

Conventionally, in an inkjet recording device, restoration processing is generally performed in which an ink whose viscosity is increased within an ink discharge port is forcefully pushed out from the ink discharge port and is wiped off with a wiper. Hence, in the inkjet recording device, a recording head which discharges the ink to a sheet (recording medium) and a wipe unit which cleans the recording head are provided.

The wipe unit includes: a wiper which wipes off the ink that is forcefully pushed out; and a recovery tray which is arranged below the wiper and which includes a tray surface that recovers the ink wiped off with the wiper. The tray surface is inclined with respect to a horizontal plane and is formed so as to pass the recovered ink in a predetermined direction and collect it.

The inkjet recording device which uses the wipe unit so as to perform the restoration processing on the recording head is conventionally known.

However, in the conventional wipe unit, the wiper is formed in the shape of a rectangle. Specifically, the lower end (lower surface) of the wiper is formed parallel to a width direction perpendicular to a wiping direction. Hence, when the ink which is pushed out to an ink discharge surface is wiped off with the wiper, the ink flows along the wiper to the lower end and drops to the tray surface in a state where the ink is spread in the width direction. When the ink drops to the tray surface in the state where the ink is spread in the width direction, and thus a small amount of ink is dispersed, the ink is unlikely to flow so as to be solidified at that place.

SUMMARY

A wipe unit according to one aspect of the present disclosure cleans a recording head including an ink discharge surface in which an ink discharge port for discharging an ink on a recording medium is opened. The wipe unit includes a wiper, a wiper carriage, a wiper fixing member and a recovery tray. The wiper wipes off the ink that is forcefully pushed out from the ink discharge port. The wiper carriage is moved along a wiping direction in a state where the wiper is held. The wiper fixing member fixes the wiper to the wiper carriage. The recovery tray is arranged below the wiper, and includes a tray surface that recovers the ink wiped off with the wiper. The tray surface is inclined with respect to a horizontal plane, and makes the recovered ink flow in a predetermined direction so as to collect the recovered ink. The wiping portion is formed with the wiper and the wiper fixing member, and the wiping portion includes an ink drop portion which drops the ink wiped off with the wiper to the tray surface. The ink drop portion is formed such that the length thereof in a width direction orthogonal to the wiping direction is reduced as the ink drop portion is extended downward.

Further other objects of the present disclosure and specific advantages obtained by the present disclosure will become more apparent from the description of an embodiment given below.

DETAILED DESCRIPTION

An embodiment of the present disclosure will be described below with reference to drawings.

Figure 1:
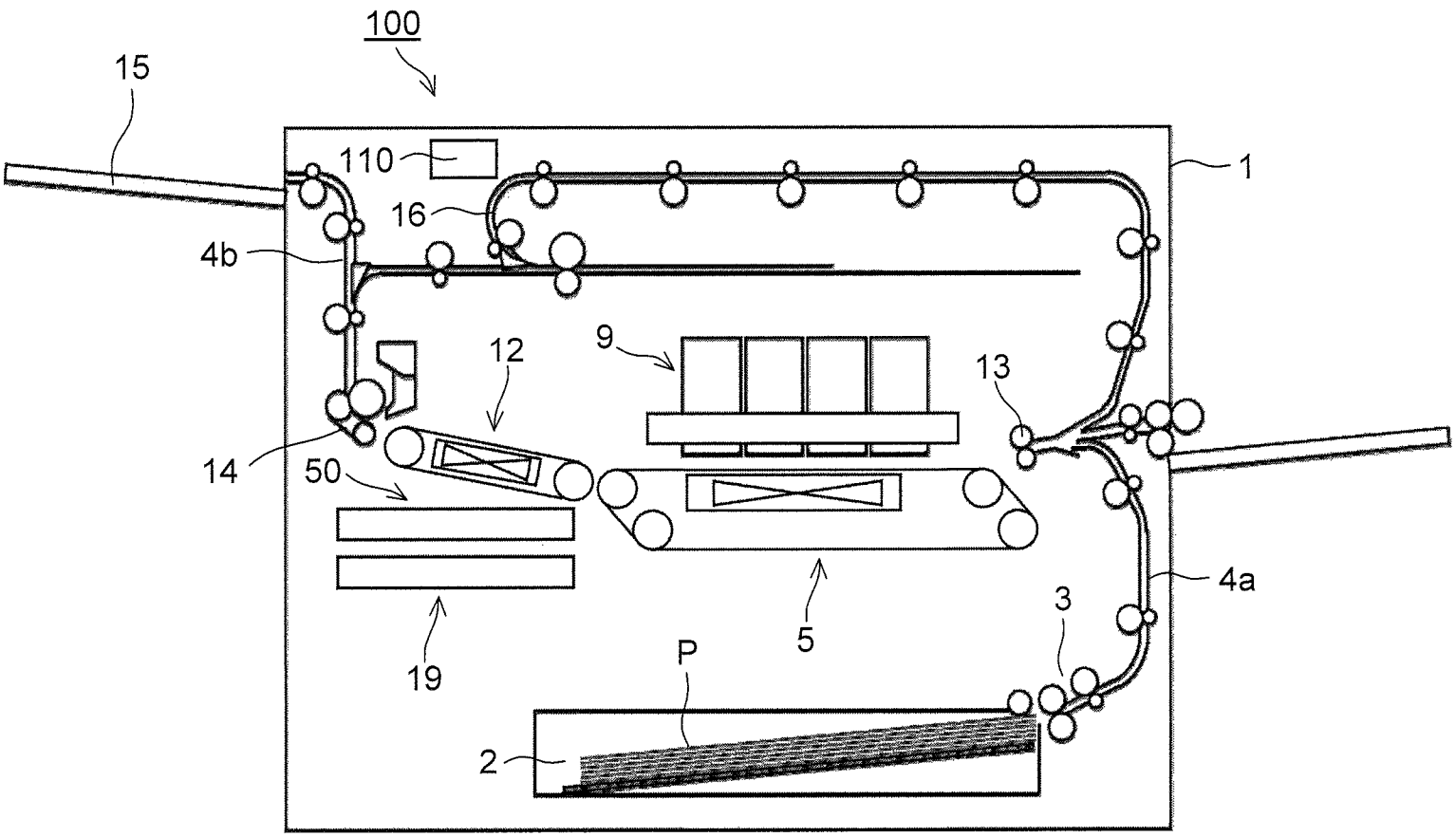
FIG. 1 is a diagram showing a schematic structure of a printer which includes a wipe unit according to an embodiment of the present disclosure.

An inkjet printer 100 (inkjet recording device) which includes a wipe unit 19 according to an embodiment of the present disclosure will be described with reference to FIGS. 1 to 21. As shown in FIG. 1, in the printer 100, a paper feed cassette 2 which is a sheet storage portion is arranged in a lower portion of the interior of a printer main body 1. Within the paper feed cassette 2, sheets P which are an example of a recording medium are stored. A paper feed device 3 is arranged on the downstream side of the paper feed cassette 2 in a sheet transport direction, that is, above the right side of the paper feed cassette 2 in FIG. 1. With the paper feed device 3, the sheets P are separated and fed out one by one upward to the right of the paper feed cassette 2 in FIG. 1.

The printer 100 also includes a first sheet transport path 4*a* therewithin. The first sheet transport path 4*a* is located upward to the right of the paper feed cassette 2 in the paper feed direction thereof. The sheet P fed out from the paper feed cassette 2 is transported with the first sheet transport path 4*a* vertically upward along the side surface of the printer main body 1.

At the downstream end of the first sheet transport path 4*a* in the sheet transport direction, a resist roller pair 13 is provided. Furthermore, a first transport unit 5 and a recording portion 9 are arranged immediately close to the downstream side of the resist roller pair 13 in the sheet transport direction. The sheet P fed out from the paper feed cassette 2 is passed through the first sheet transport path 4*a* so as to reach the resist roller pair 13. The resist roller pair 13 feeds out the sheet P toward the first transport unit 5 while correcting the oblique feeding of the sheet P and matching timing at which the recording portion 9 performs an ink discharge operation.

On the downstream side (the left side of FIG. 1) of the first transport unit 5 in the sheet transport direction, a second transport unit 12 is arranged. The sheet P on which an ink image is recorded in the recording portion 9 is fed to the second transport unit 12, and while the sheet P is being passed through the second transport unit 12, inks which are discharged on the surface of the sheet P are dried.

A decurler portion 14 is provided on the downstream side of the second transport unit 12 in the sheet transport direction and in the vicinity of the left side surface of the printer main body 1. The sheet P in which the inks are dried in the second transport unit 12 is fed to the decurler portion 14, and a curl produced in the sheet P is corrected.

On the downstream side (the upper side of FIG. 1) of the decurler portion 14 in the sheet transport direction, a second sheet transport path 4*b* is provided. When double-sided recording is not performed on the sheet P which is passed through the decurler portion 14, the sheet P is ejected from the second sheet transport path 4*b* to a sheet ejection tray 15 which is provided on the outside of the left side surface of the printer 100.

A reverse transport path 16 for performing double-sided recording is provided in an upper portion of the printer main body 1 and above the recording portion 9 and the second transport unit 12. When the double-sided recording is performed, the sheet P in which recording on a first sheet is completed and which is passed through the second transport unit 12 and the decurler portion 14 is passed through the second sheet transport path 4*b* and is fed to the reverse transport path 16. Then, in the sheet P fed to the reverse transport path 16, the transport direction is switched for recording on a second surface, and the sheet P is passed through the upper portion of the printer main body 1, is fed toward the right side, is passed through the first sheet transport path 4*a* and the resist roller pair 13 and is fed again to the first transport unit 5 in a state where the second surface is faced upward.

The wipe unit 19 and a cap unit 50 are arranged below the second transport unit 12. When purge which will be described later is performed, the wipe unit 19 is moved horizontally below the recording portion 9 so as to wipe off the inks which are pushed out from the ink discharge ports of recording heads and to recover the inks which are wiped off. When the ink discharge surfaces of the recording heads are capped, the cap unit 50 is moved horizontally below the recording portion 9 and is further moved upward so as to be fitted to the lower surfaces of the recording heads.

Figure 2:
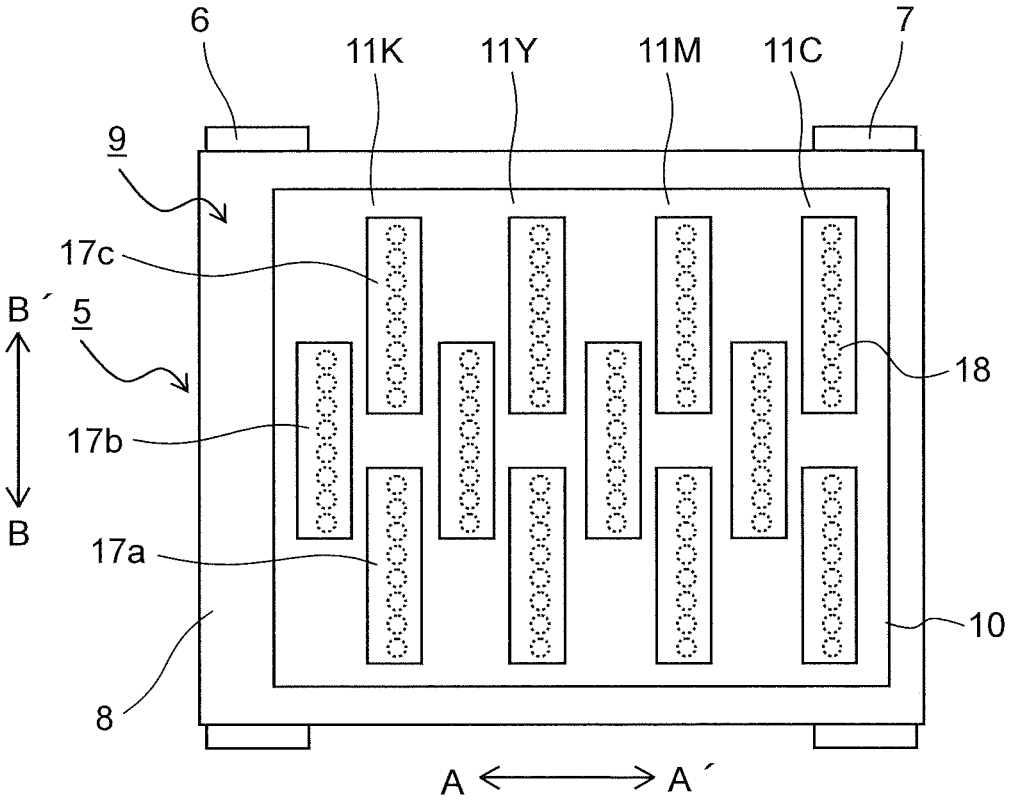
FIG. 2 is a diagram showing, from above, a first transport unit and a recording portion in the printer according to the embodiment of the present disclosure.
Figure 3:
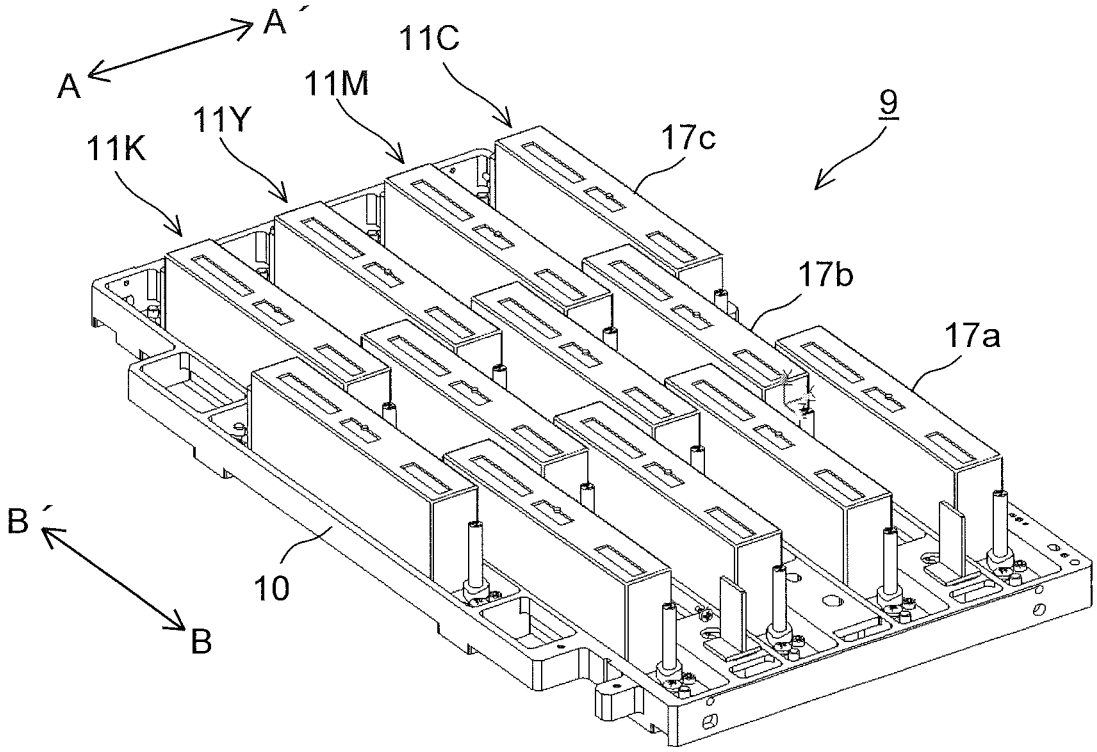
FIG. 3 is a diagram showing a structure of the recording portion in the printer according to the embodiment of the present disclosure.

As shown in FIGS. 2 and 3, the recording portion 9 includes a head housing 10 and line heads 11C, 11M, 11Y and 11K which are held by the head housing 10. These line heads 11C to 11K are supported at such a height that a predetermined spacing (for example, 1 mm) is formed with respect to the transport surface of a first transport belt 8 which is extended over a plurality of rollers including a drive roller 6 and a driven roller 7, and a plurality of (here, three) recording heads 17*a* to 17*c* are provided in a staggered arrangement along a sheet width direction (the direction of arrows B and B') orthogonal to the sheet transport direction (the direction of an arrow A).

Figure 4:
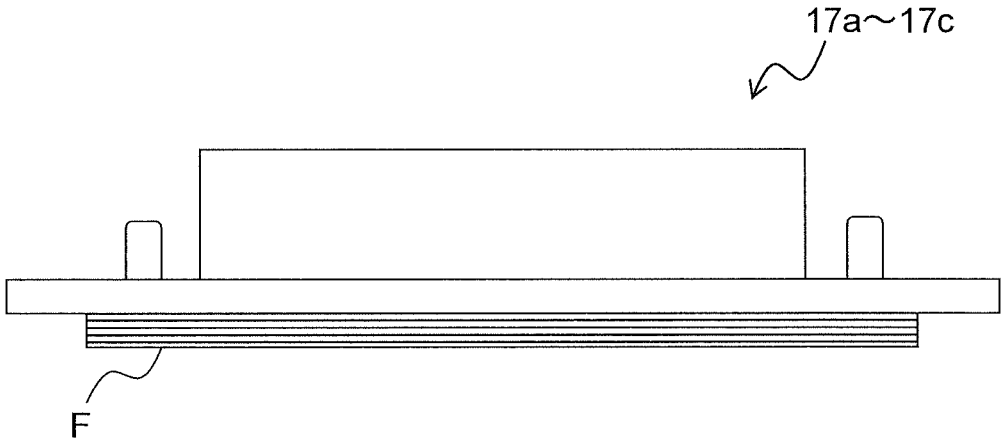
FIG. 4 is a diagram showing a structure of recording heads which form the line heads of the recording portion in the printer according to the embodiment of the present disclosure.
Figure 5:
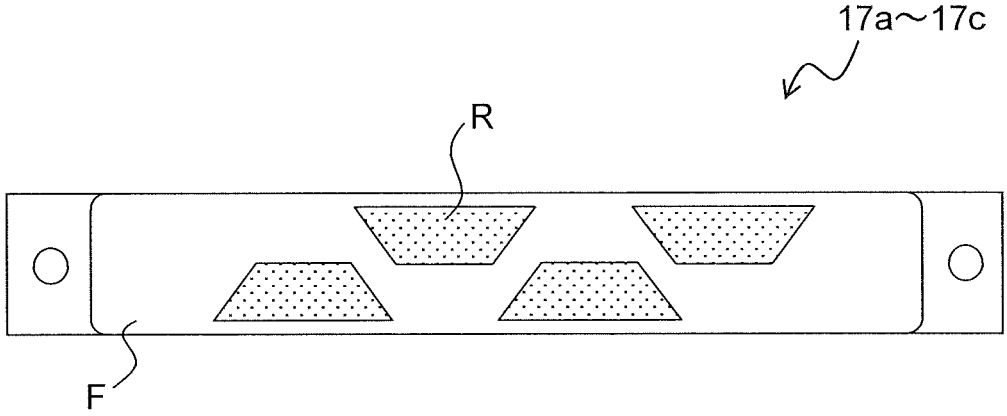
FIG. 5 is a diagram showing, from the side of an ink discharge surface, the recording head in the printer according to the embodiment of the present disclosure.

As shown in FIGS. 4 and 5, in the ink discharge surfaces F of the recording heads 17*a* to 17*c*, ink discharge regions R are provided in which a large number of ink discharge ports 18 (see FIG. 2) are arranged. Since the recording heads 17*a* to 17*c* have the same shape and configuration, in FIGS. 4 and 5, the recording heads 17*a* to 17*c* are shown as one figure.

The inks of four colors (cyan, magenta, yellow and black) which are stored in individual ink tanks (unillustrated) are supplied, for the individual colors of the line heads 11C to 11K, to the recording heads 17*a* to 17*c* of the line heads 11C to 11K.

The recording heads 17*a* to 17*c* use control signals from a control portion 110 (see FIG. 1) controlling the entire printer 100 so as to discharge, according to image data received from an external computer or the like, the inks from the ink discharge ports 18 toward the sheet P which is sucked and held to the transport surface of the first transport belt 8 and which is transported. In this way, on the sheet P on the first transport belt 8, a color image is formed in which the inks of the four colors of cyan, magenta, yellow and black are stacked on each other.

In the printer 100, in order for the ink discharge surfaces F of the recording heads 17*a* to 17*c* to be cleaned, at the time of start of printing after a long-term stop and during an interval between printing operations, the inks are forcefully discharged from the ink discharge ports 18 of all the recording heads 17*a* to 17*c*, the ink discharge surfaces F are wiped with wipers 35*a* to 35*c* (see FIG. 12) which will be described later and the subsequent printing operation is prepared for.

The cap unit 50, the wipe unit 19 and a structure in the vicinity thereof will then be described in detail.

Figure 6:
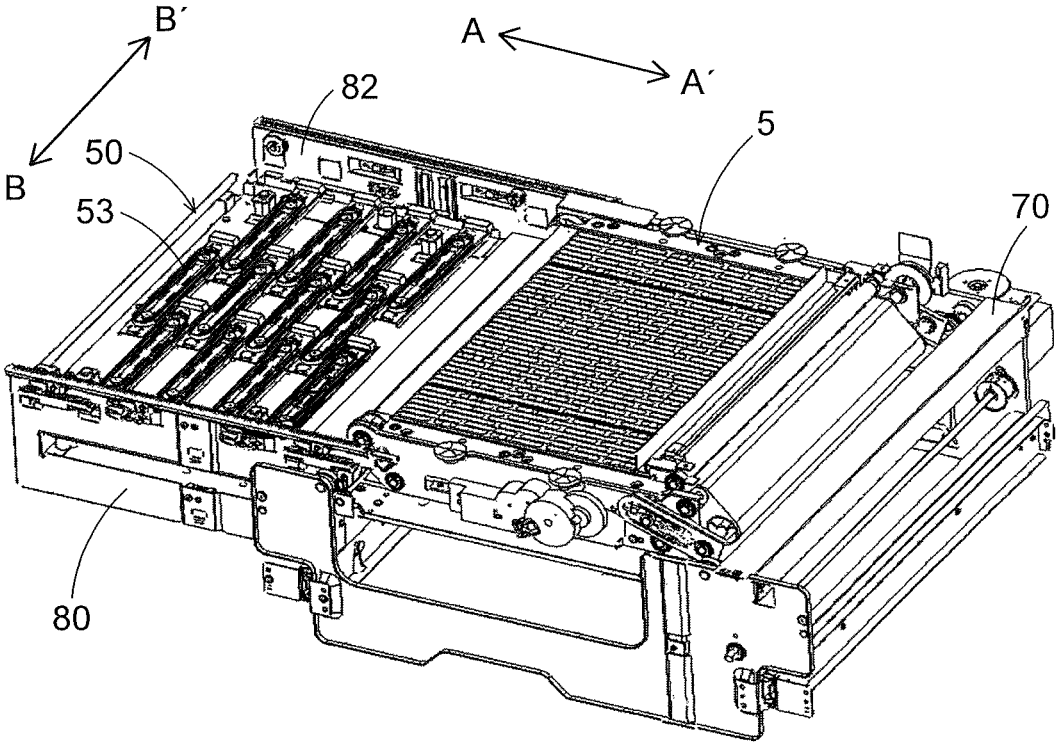
FIG. 6 is a diagram showing a structure of a cap unit, the first transport unit and the like in the printer according to the embodiment of the present disclosure, and is also a diagram showing a state where the first transport unit is arranged in a raised position.
Figure 7:
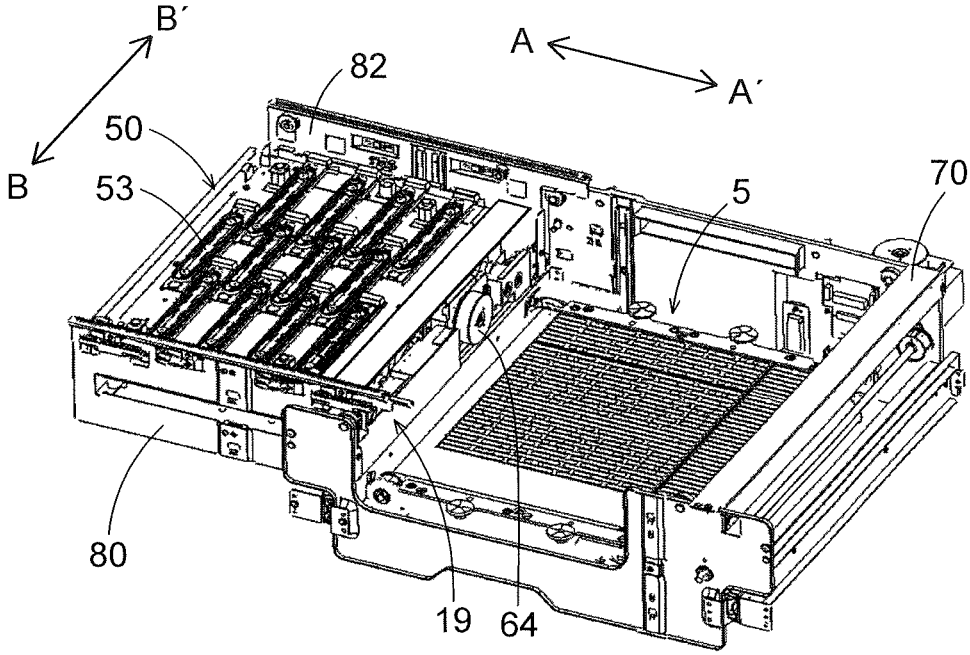
FIG. 7 is a diagram showing the structure of the cap unit, the first transport unit and the like in the printer according to the embodiment of the present disclosure, and is also a diagram showing a state where the first transport unit is arranged in a lowered position.

As shown in FIGS. 6 and 7, the first transport unit 5 is stored in a storage frame 70. The first transport unit 5 is configured such that it can be raised and lowered in an up/down direction with a transport raising/lowering mechanism (unillustrated) which is formed with a raising/lowering drive source, a gear train and the like. The first transport unit 5 is arranged in a raised position (the position of FIG. 6) when the printing operation is performed so as to be close to the ink discharge surfaces F of the recording heads 17*a* to 17*c*. The first transport unit 5 is arranged in a lowered position (the position of FIG. 7) when a restoration operation which will be described later is performed on the recording heads 17*a* to 17*c* and when a capping operation which will be described later is performed thereon.

Figure 8:
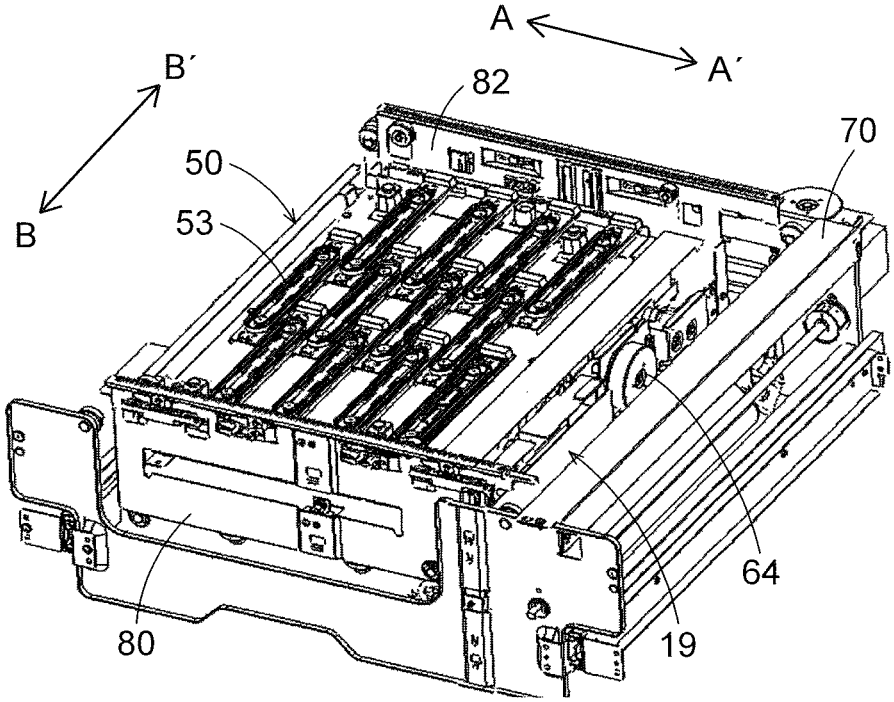
FIG. 8 is a diagram showing a structure of the cap unit and the like in the printer according to the embodiment of the present disclosure, and is also a diagram showing a state where the cap unit and the wipe unit are arranged in a first position.
Figure 9:
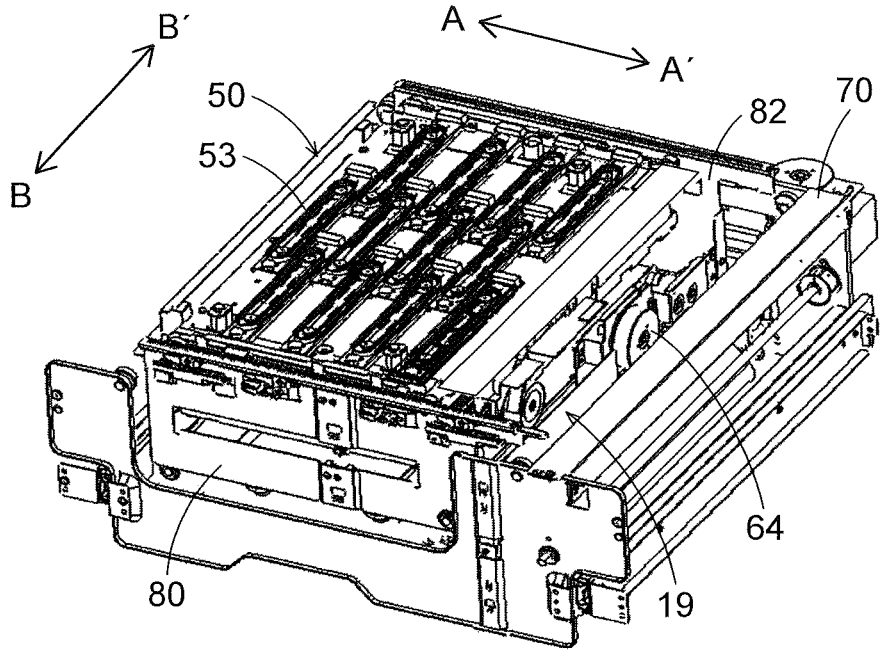
FIG. 9 is a diagram showing a state where the cap unit and the wipe unit are raised from the state of FIG. 8.

As shown in FIGS. 7 and 8, the cap unit 50 is configured such that it can reciprocate between a first position (the position of FIG. 8) which is immediately below the recording portion 9 and a second position (the position of FIG. 7) which is retracted from the first position in a horizontal direction (the direction of the arrow A). When the cap unit 50 is arranged in the first position, the first transport unit 5 is arranged in the lowered position. As shown in FIGS. 8 and 9, the cap unit 50 is configured such that in the first position, it can be raised and lowered in the up/down direction.

The cap unit 50 is arranged in the second position (the position of FIG. 6) when the printing operation is performed and when the restoration operation is performed. The cap unit 50 is configured such that when the capping operation is performed, the cap unit 50 is moved upward in the first position (the position of FIGS. 8 and 9) so as to cap the recording heads 17*a* to 17*c*. The cap unit 50 is configured such that as will be described later, in the second position, the cap unit 50 can be coupled to the wipe unit 19 and decoupled therefrom, and the movements of the cap unit 50 in the horizontal direction and the up/down direction are performed in a state where the wipe unit 19 is coupled to the cap unit 50.

Figure 10:
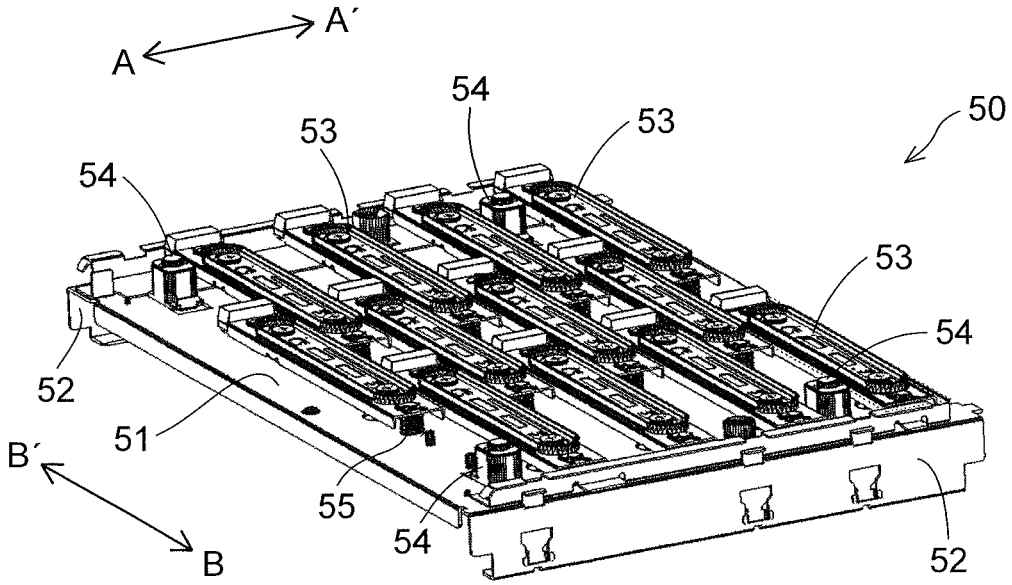
FIG. 10 is a diagram showing a structure of the cap unit in the printer according to the embodiment of the present disclosure.

As shown in FIG. 10, the cap unit 50 includes: a cap tray 51 made of sheet metal; a pair of tray side plates 52 which are formed at both ends of the cap tray 51 in the sheet width direction (the direction of the arrows B and B'); twelve concave cap portions 53 which are arranged on the upper surface of the cap tray 51; and four height-direction locating protrusions 54.

The cap portions 53 are arranged in positions corresponding to the recording heads 17*a* to 17*c*. In this way, as shown in FIG. 9, in the first position, the cap unit 50 is moved upward, and thus the cap portions 53 cap the ink discharge surfaces F of the recording heads 17*a* to 17*c*. When the cap unit 50 is raised to the side of the recording portion 9 in order to cap the recording heads 17*a* to 17*c*, the height-direction locating protrusions 54 make contact with the housing 10 of the recording portion 9 so as to locate the cap tray 51 in the height direction. Between the lower portions of the cap portions 53 at both ends in a longitudinal direction (the direction of the arrows B and B') and the cap tray 51, cap springs 55 formed with compression springs are arranged. With the cap springs 55, the state of contact between the cap portions 53 and the ink discharge surfaces F is held constant.

Figure 11:
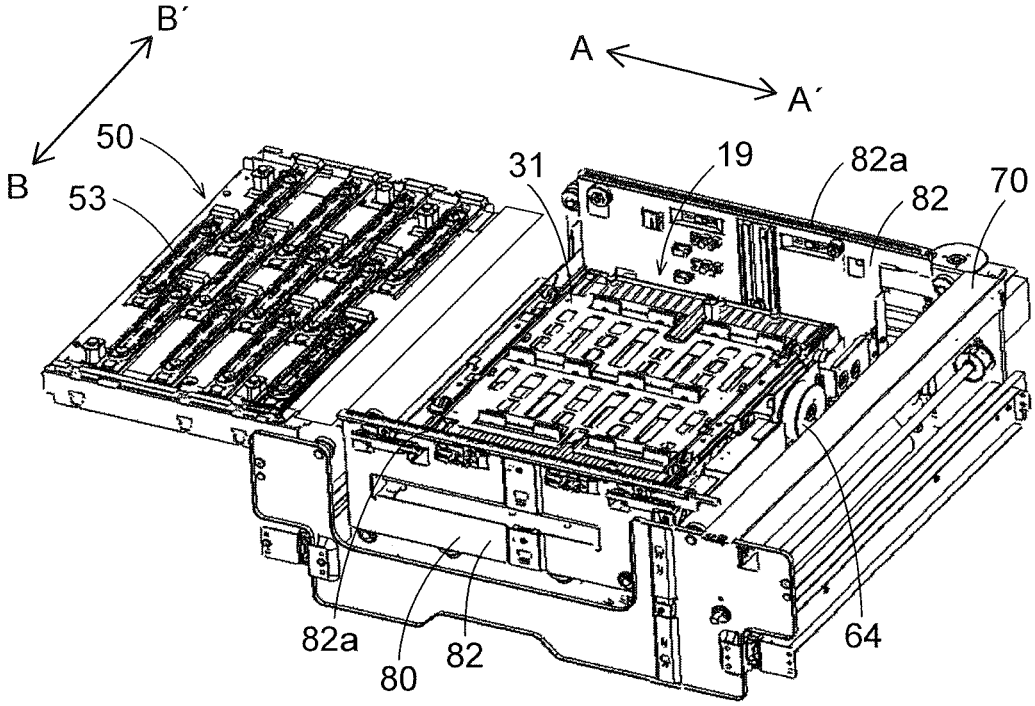
FIG. 11 is a diagram showing a structure of the cap unit, the wipe unit and the like in the printer according to the embodiment of the present disclosure, and is also a diagram showing a state where the cap unit is arranged in a second position and where the wipe unit is in the first position.
Figure 12:
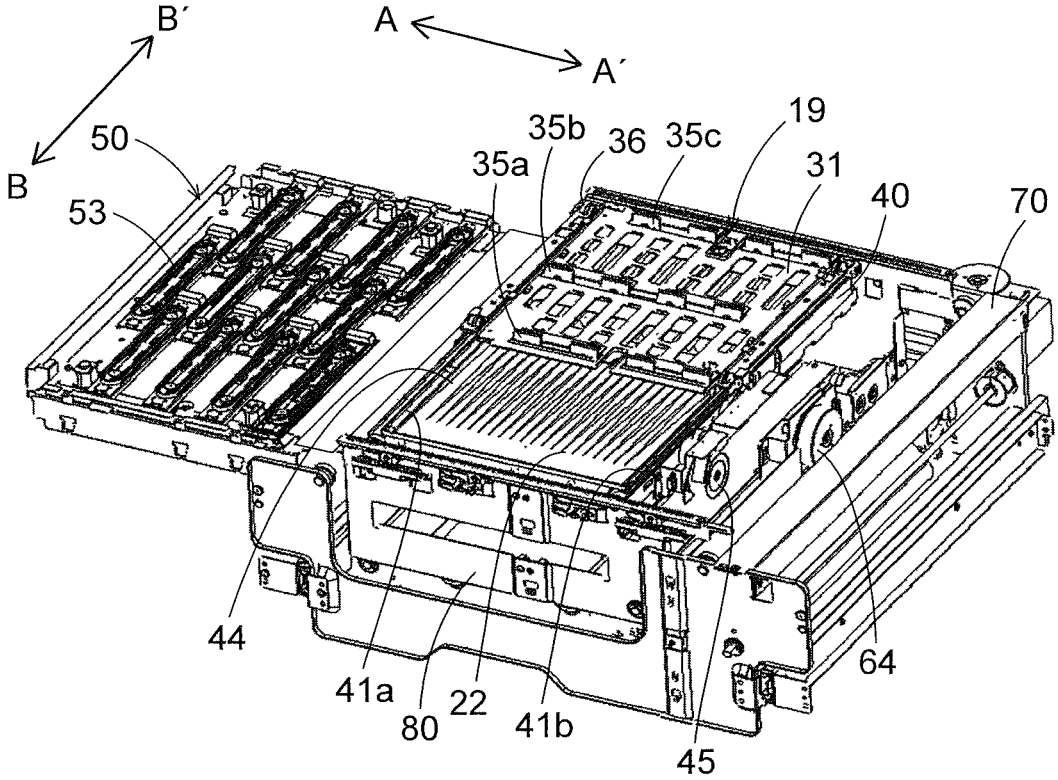
FIG. 12 is a diagram showing a state where the wipe unit is raised from the state of FIG. 11.

As shown in FIGS. 7 and 11, the wipe unit 19 is configured such that it can reciprocate between the first position (the position of FIG. 11) which is immediately below the recording portion 9 and the second position (the position of FIG. 7) which is retracted from the first position in the horizontal direction (the direction of the arrow A). When the wipe unit 19 is arranged in the first position, the first transport unit 5 is arranged in the lowered position. As shown in FIGS. 11 and 12, the wipe unit 19 is configured such that in the first position, it can be raised and lowered in the up/down direction.

The wipe unit 19 is arranged in the second position when the printing operation is performed. The wipe unit 19 is configured such that in the first position (the position of FIG. 11), the wipe unit 19 is moved upward when the restoration operation is performed and when the capping operation is performed.

Figure 13:
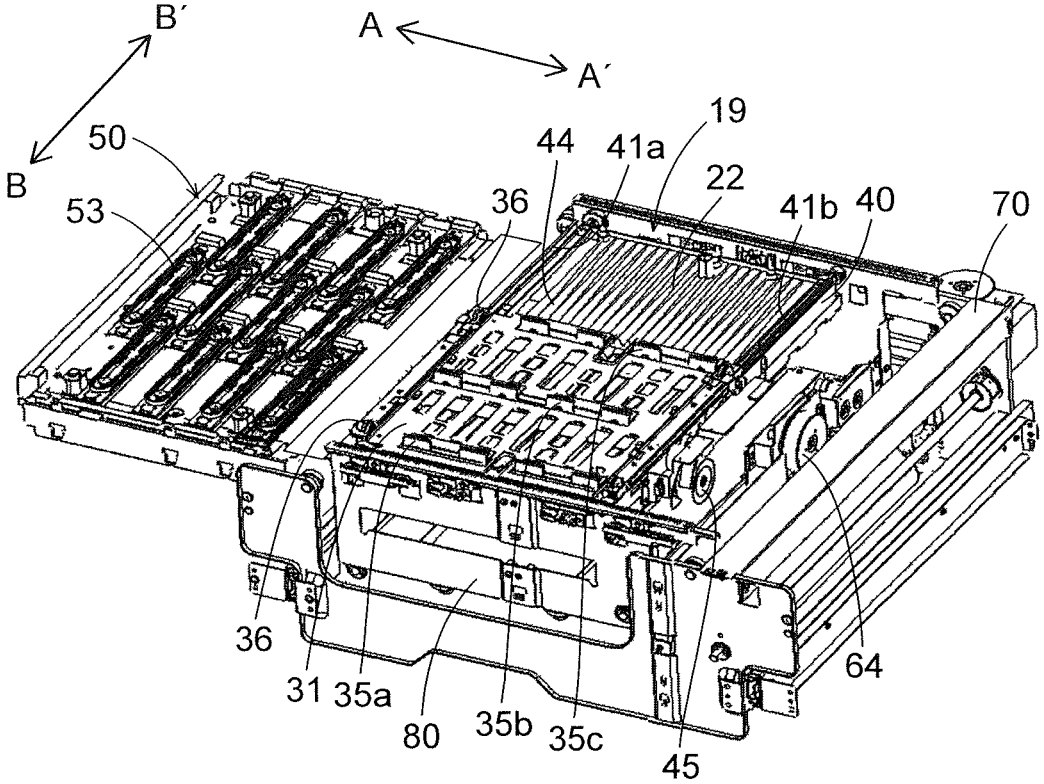
FIG. 13 is a diagram showing a state where a wiper carriage is moved in the direction of an arrow B from the state of FIG. 12.

As shown in FIGS. 12 and 13, the wipe unit 19 is formed with a substantially rectangular wiper carriage 31 to which the wipers 35*a* to 35*c* are fixed and a support frame 40 which supports the wiper carriage 31.

On the end edges of the upper surface of the support frame 40 which are opposite each other in the direction of the arrows A and A', rail portions 41*a* and 41*b* are formed, rollers 36 which are provided in the four corners of the wiper carriage 31 make contact with the rail portions 41*a* and 41*b* and thus the wiper carriage 31 is supported to the support frame 40 such that it can slide in the direction of the arrows B and B'.

A wiper carriage movement motor 45 for moving the wiper carriage 31 in the horizontal direction (the direction of the arrows B and B') and a gear train (unillustrated) which engages with the wiper carriage movement motor 45 and the rack teeth (unillustrated) of the wiper carriage 31 are attached to the outside of the support frame 40. The wiper carriage movement motor 45 is rotated forward and backward, and thus the gear train is rotated forward and backward, with the result that the wiper carriage 31 reciprocates in the horizontal direction (the direction of the arrows B and B').

The wipers 35*a* to 35*c* are elastic members (for example, rubber members made of EPDM) for wiping off the inks which are pushed out from the ink discharge ports 18 of the recording heads 17*a* to 17*c*. The wipers 35*a* to 35*c* are pressed, from a substantially vertical direction, to wiping start positions outside the ink discharge regions R (see FIG. 5) where the ink discharge ports 18 are open, and by the movement of the wiper carriage 31, the wipers 35*a* to 35*c* wipe the ink discharge surfaces F including the ink discharge regions R in a predetermined direction (the direction of the arrow B in FIG. 12).

The four wipers 35*a* are arranged at substantially regular intervals, and the four wipers 35*b* and the four wipers 35*c* are likewise arranged at substantially regular intervals. The wipers 35*a* and 35*c* are respectively arranged in positions corresponding to the recording heads 17*a* and 17*c* (see FIG. 3) of the line heads 11C to 11K. The wipers 35*b* are arranged in positions corresponding to the recording heads 17*b* (see FIG. 3) of the line heads 11C to 11K, and are fixed so as to be displaced only a predetermined distance with respect to the wipers 35*a* and 35*c* in a direction (the direction of the arrows A and A') orthogonal to the direction of movement of the wiper carriage 31.

On the upper surface of the support frame 40, a recovery tray 44 is arranged which recovers the waste inks which are wiped off from the ink discharge surfaces F with the wipers 35*a* to 35*c*. The waste inks recovered in the recovery tray 44 are stored in a waste ink tank 93 which will be described later. A structure in the vicinity of the recovery tray 44 will be described later.

As shown in FIG. 7, the wipe unit 19 is stored in a carriage 80 whose cross section is formed in the shape of the letter U, and is arranged below the cap unit 50 in the second position. When as shown in FIGS. 7 and 11, the wipe unit 19 is moved in the horizontal direction (the direction of the arrows A and A'), the wipe unit 19 is moved together with the carriage 80 whereas when as shown in FIGS. 11 and 12, the wipe unit 19 is moved in the up/down direction, the wipe unit 19 is moved in the up/down direction with respect to the carriage 80.

Figure 14:
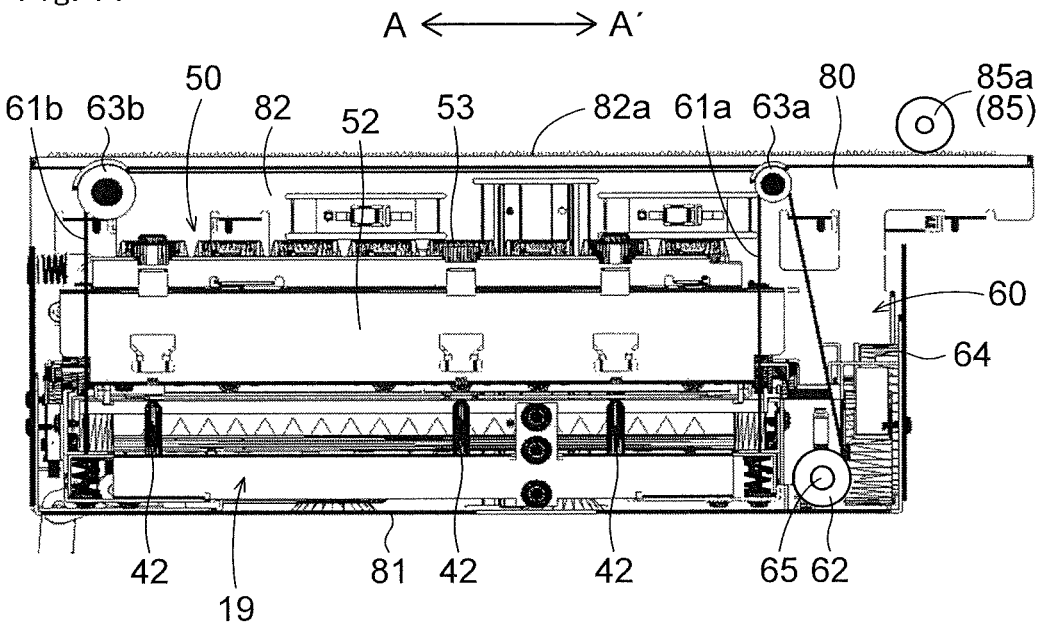
FIG. 14 is a diagram showing a structure in the vicinity of a unit raising/lowering mechanism in the printer according to the embodiment of the present disclosure.

The carriage 80 is formed with: a carriage bottom plate 81 (see FIG. 14) on which the wipe unit 19 is placed and which is made of sheet metal; and a pair of carriage side plates 82 which are provided so as to stand at both ends of the carriage bottom plate 81 in the sheet width direction (the direction of the arrows B and B'). The carriage side plates 82 are configured such that they can slide on the carriage support rails (unillustrated) of the printer main body 1. As shown in FIG. 14, on the upper surfaces of the carriage side plates 82, rack portions 82*a* which include rack teeth are formed. Gears 85*a* engage with the rack portion 82*a*, and the gear train including the gears 85*a* is connected to a carriage drive source (unillustrated) formed with a motor. The carriage drive source is rotated forward and backward, and thus the gear train is rotated forward and backward, with the result that the carriage 80 reciprocates between the first position and the second position. With the gear train including the gears 85*a* and the carriage drive source, a unit horizontal movement mechanism 85 is formed which moves the cap unit 50 and the wipe unit 19 in the horizontal direction.

As shown in FIG. 14, within the carriage 80, a unit raising/lowering mechanism 60 is provided which raises and lowers the wipe unit 19 in the up/down direction. The unit raising/lowering mechanism 60 includes wires 61*a* and 61*b*, a winding pulley 62 which winds the wires 61*a* and 61*b*, pulleys 63*a* and 63*b* which convert the directions of the wires 61*a* and 61*b* and a winding drive motor (winding drive source) 64.

The wire 61*a* is attached from the winding pulley 62 through the pulley 63*a* to a lower portion of the wipe unit 19 in the direction of the arrow A'. The wire 61*b* is attached from the winding pulley 62 through the pulleys 63*a* and 63*b* to a lower portion of the wipe unit 19 in the direction of the arrow A. The wires 61*a* and 61*b*, the winding pulley 62 and the pulleys 63*a* and 63*b* are provided on each of both sides (the front and back sides with respect to the plane of FIG. 14) in the direction of the arrows B and B'. The pair of winding pulleys 62 are fixed to both ends of one rotation shaft 65. A rotation shaft gear (unillustrated) which engages with the gear train (unillustrated) connected to the winding drive motor 64 is fixed to the rotation shaft 65. The winding drive motor 64 is rotated forward and backward, and thus the winding pulley 62 is rotated forward and backward.

Figure 15:
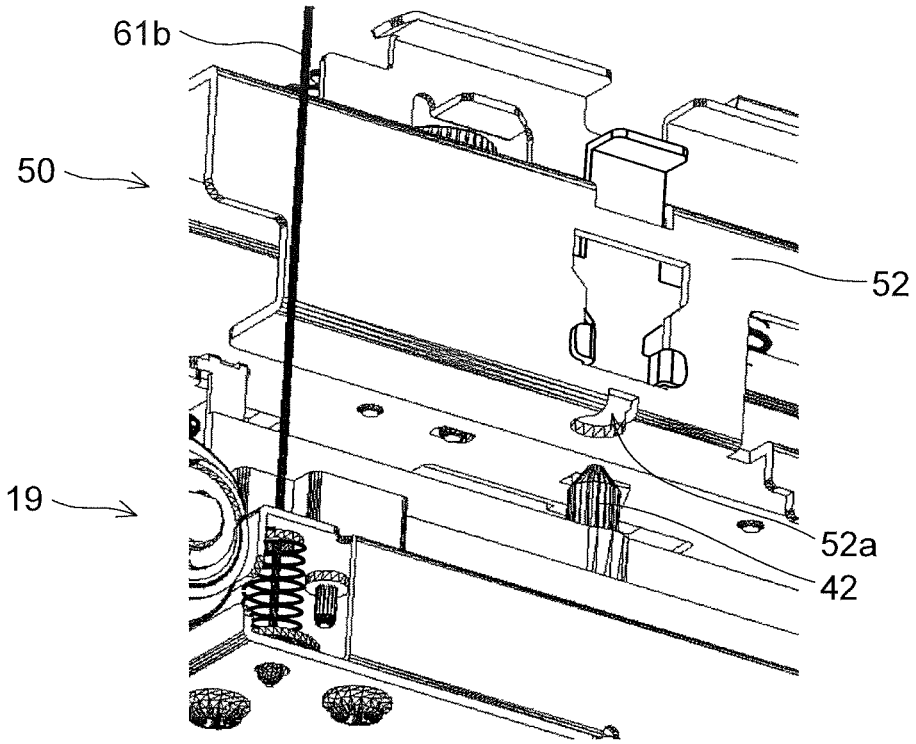
FIG. 15 is a diagram showing a structure in the vicinity of a coupling pin and a pushing-up piece in the printer according to the embodiment of the present disclosure, and is also a diagram showing a state where the wipe unit and the cap unit are not coupled to each other.

In the wipe unit 19, as shown in FIGS. 14 and 15, a plurality of coupling pins 42 which are extended upward are provided. In the lower surfaces of the tray side plates 52 of the cap unit 50, coupling holes 52*a* (see FIG. 15) are formed in positions corresponding to the coupling pins 42. The coupling pins 42 and the coupling holes 52*a* form a coupling mechanism which couples or decouples the cap unit 50 and the wipe unit 19.

Figure 16:
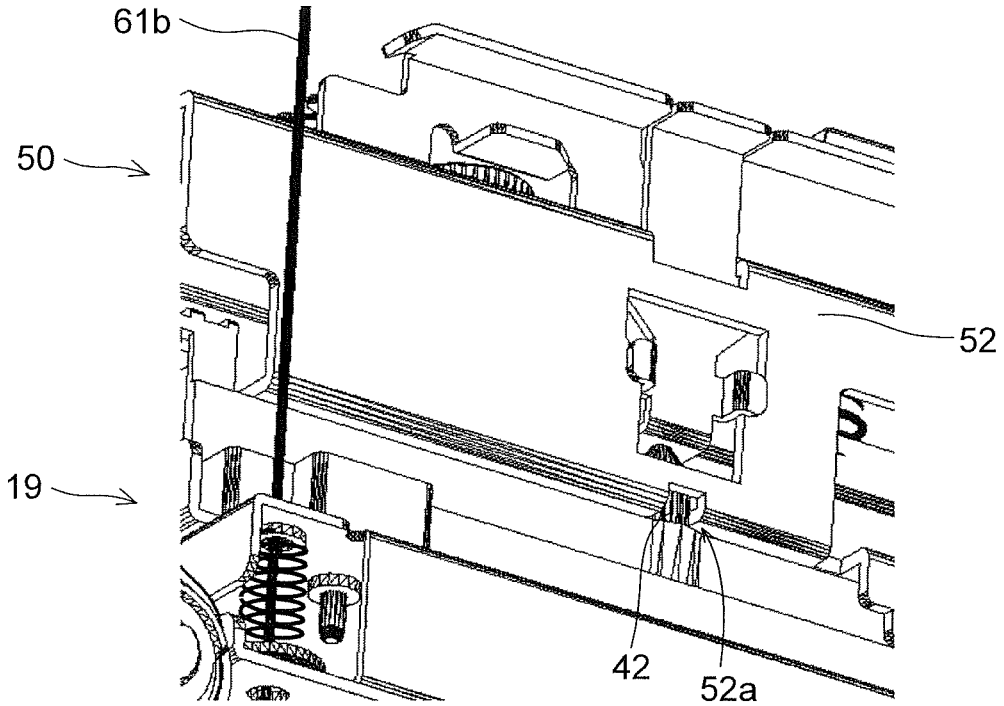
FIG. 16 is a diagram showing the structure in the vicinity of the coupling pin and the pushing-up piece in the printer according to the embodiment of the present disclosure, and is also a diagram showing a state where the wipe unit and the cap unit are coupled to each other.

In a state where the wipe unit 19 is lowered in the second position (the state of FIG. 14, the state where the wipe unit 19 is arranged in a first height position), as shown in FIG. 15, the coupling pins 42 are not inserted into the coupling holes 52*a*, and the wipe unit 19 and the cap unit 50 are not coupled to each other (the coupling is released). On the other hand, when the wipe unit 19 is raised in the second position (the wipe unit 19 is arranged in a second height position higher than the first height position), as shown in FIG. 16, the coupling pins 42 are inserted into the coupling holes 52*a*, and thus the wipe unit 19 and the cap unit 50 are coupled to each other. In this way, the cap unit 50 is integral with the wipe unit 19 such that they can be moved in the horizontal direction and the up/down direction.

In the second position, a cap support portion (unillustrated) is provided which supports the cap unit 50 in a state where the wipe unit 19 and the cap unit 50 are not coupled to each other (the state where the coupling is released). In the second position, a lid member (unillustrated) is also provided which makes intimate contact with the cap portions 53 of the cap unit 50 so as to protect the cap portions 53 in a state where the wipe unit 19 and the cap unit 50 are not coupled to each other (the state other than the capping operation (the state of the printing operation and the restoration operation)). The lid member (unillustrated) makes intimate contact with the cap portions 53 from above, and thus foreign substances such dust and paper powder are prevented from being adhered to the upper surfaces of the cap portions 53 (the surfaces which make intimate contact with the ink discharge surfaces F) and a phenomenon is reduced in which water within the cap portions 53 is evaporated so as to disappear.

A structure in the vicinity of the wipers 35*a* to 35*c* will then be described in detail.

Figure 17:
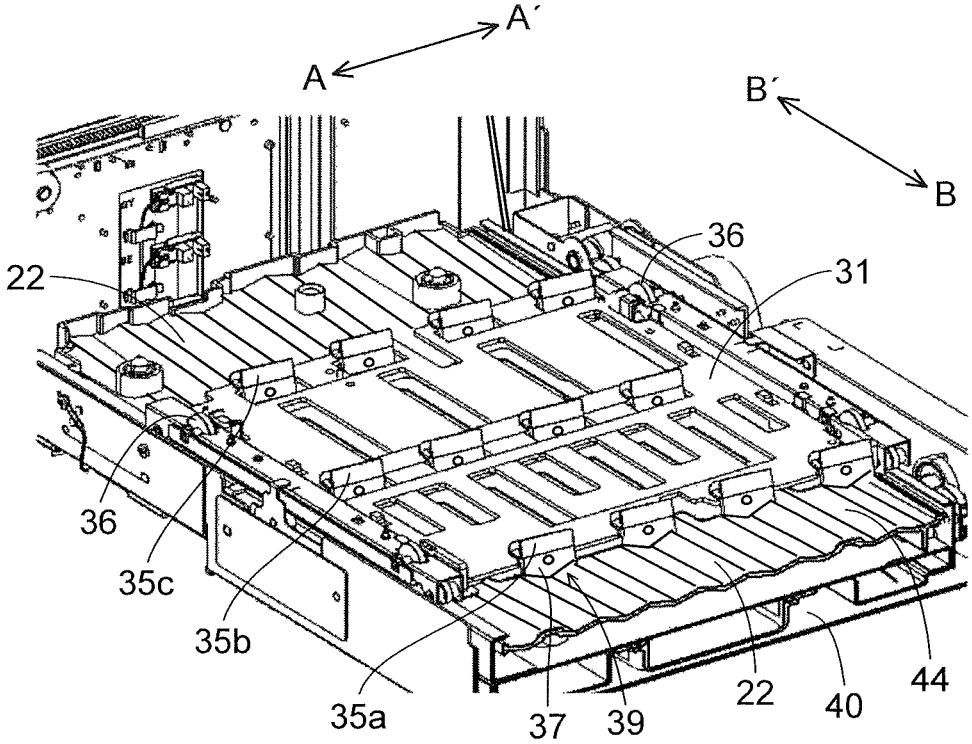
FIG. 17 is a diagram showing a structure in the vicinity of the wipe unit and the wiper carriage in the embodiment of the present disclosure.

As shown in FIG. 17, the wipers 35*a* to 35*c* are fixed with wiper fixing members 37 to the wiper carriage 31. In the present embodiment, the wipers 35*a* to 35*c* are fixed with the wiper fixing members 37 and fixing auxiliary members 38 (see FIG. 18) to the wiper carriage 31.

Figure 18:
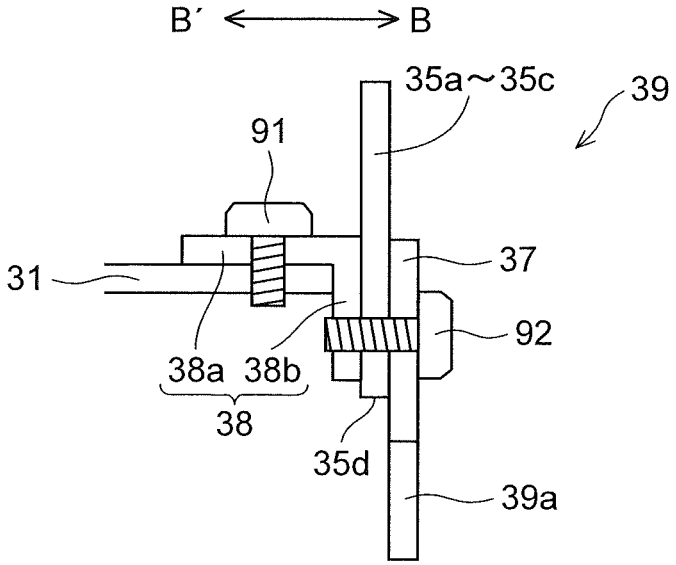
FIG. 18 is a diagram showing a structure of a wiping portion in the wipe unit in the embodiment of the present disclosure.

Specifically, as shown in FIG. 18, the fixing auxiliary member 38 which is formed in the shape of the letter L when seen in cross section and which is made of resin is fixed with a screw 91 to a predetermined position of the wiper carriage 31 made of sheet metal. The fixing auxiliary member 38 includes: a fixing portion 38*a* which is extended in the horizontal direction and which is fixed to the wiper carriage 31; a vertical portion 38*b* which is extended vertically downward from the end portion of the fixing portion 38*a* on the downstream side in a wiping direction (the direction of the arrow B).

The wipers 35*a* to 35*c* are fixed with screws 92 to the surfaces of the vertical portions 38*b* in the direction of the arrow B in a state where the wipers 35*a* to 35*c* are sandwiched between the vertical portions 38*b* and the wiper fixing members 37.

Figure 19:
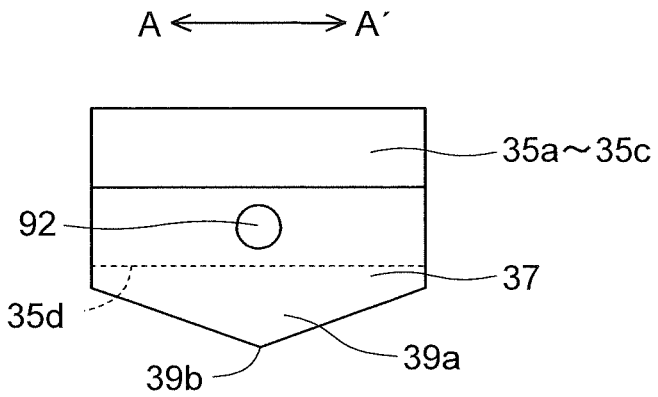
FIG. 19 is a diagram showing a structure of a wiper and a wiper fixing member in the wipe unit in the embodiment of the present disclosure.

In the present embodiment, wiping portions 39 are formed with the wipers 35*a* to 35*c*, the wiper fixing members 37 and the fixing auxiliary members 38. The wiping portion 39 includes an ink drop portion 39*a* which drops, to the tray surfaces 22 of the recovery tray 44 that will be described later, the inks which are wiped off with the wipers 35*a* to 35*c*. Here, as shown in FIGS. 18 and 19, the wiper fixing members 37 are formed downward beyond the lower ends 35*d* of the wipers 35*a* to 35*c*, and thus the inks wiped off with the wipers 35*a* to 35*c* are moved along the wipers 35*a* to 35*c* to the wiper fixing members 37 and are dropped from the lower end portions of the wiper fixing members 37. In other words, the lower end portion of the wiper fixing member 37 is the ink drop portion 39*a*.

As shown in FIG. 19, the wipers 35*a* to 35*c* are formed in the shape of a rectangle when seen in the wiping direction (the direction of the arrow B). The wiper fixing members 37 are formed so as to have a substantially same length as the wipers 35*a* to 35*c* in the direction of the arrows A and A'. The lower end portion (the ink drop portion 39*a*) of the wiper fixing member 37 is formed such that its length in the direction of the arrows A and A' is decreased as the lower end portion is extended downward. Here, the lower end portion (the ink drop portion 39*a*) of the wiper fixing member 37 is formed in the shape of an inverted triangle. In this way, the inks wiped off with the wipers 35*a* to 35*c* are dropped from the lowest end 39*b* of the ink drop portion 39*a*. The end edge (lower surface, lower end edge) of the ink drop portion 39*a* which is extended in the direction of the arrows A and A' is inclined with respect to the direction of the arrows A and A' at an angle which is equal to or more than 10 degrees but equal to or less than 30 degrees (here, about 20 degrees).

The structure of the recovery tray 44 will then be described in detail.

Figure 20:
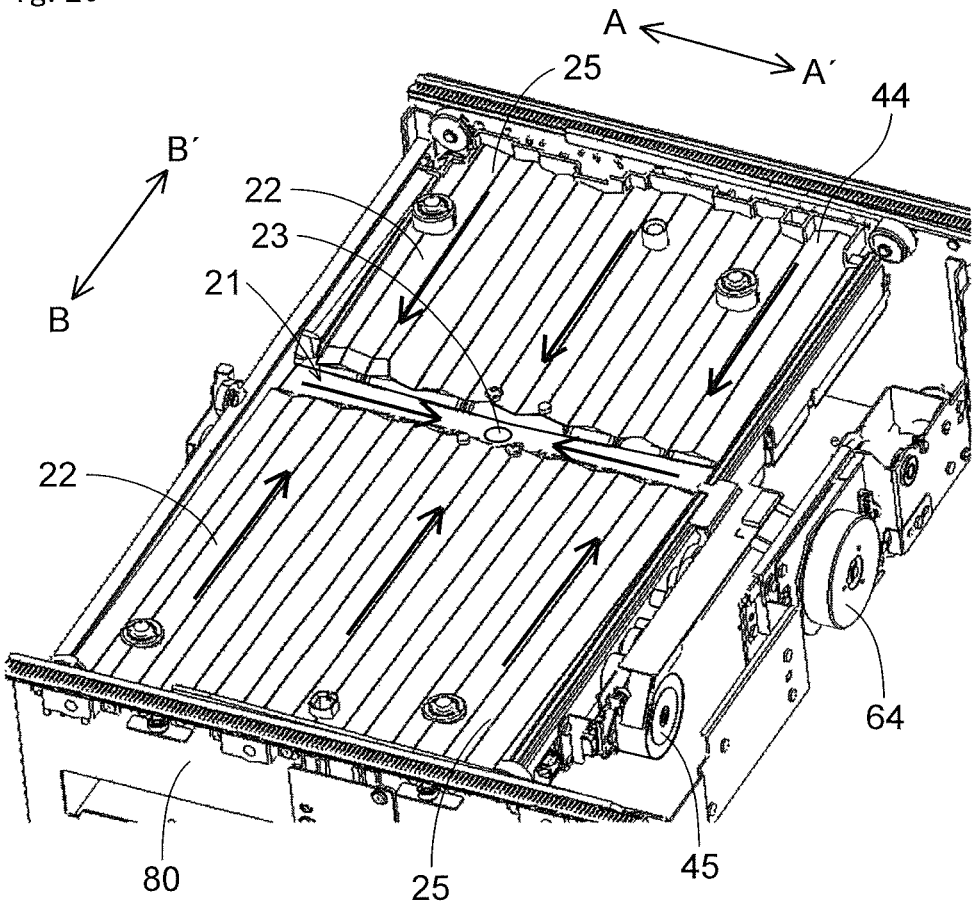
FIG. 20 is a diagram showing a structure in the vicinity of the wipe unit and a recovery tray in the embodiment of the present disclosure.

As shown in FIG. 17, the recovery tray 44 is arranged below the wipers 35*a* to 35*c* so as to recover the inks wiped off with the wipers 35*a* to 35*c*. As shown in FIG. 20, in the upper surface of the recovery tray 44, a center groove 21 which is arranged in a center portion in the direction of the arrows B and B' and which is extended in the direction of the arrows A and A' and a pair of tray surfaces 22 which are arranged on both sides in the direction of the arrows B and B' through the center groove 21 and which receive the inks are provided. The tray surfaces 22 are inclined downward toward the center groove 21. In this way, the inks dropped to the tray surfaces 22 flow toward the center groove 21 and are collected.

The center groove 21 is formed so as to be inclined downward toward the center portion in the direction of the arrows A and A'. In the center portion of the center groove 21 in the direction of the arrows A and A', a discharge port 23 is provided which discharges the recovered inks downward. A discharge tube connected to the waste ink tank (both of which are not illustrated) is connected to the discharge port 23. The inks which are wiped off from the ink discharge surfaces F with the wipers 35*a* to 35*c* and which are dropped to the tray surfaces 22 flow toward the center groove 21 on the tray surfaces 22, thereafter flow toward the discharge port 23 within the center groove 21 and are discharged from the discharge port 23.

In the tray surfaces 22, a plurality of grooves 25 are provided which are extended in the direction of the arrows B and B' and which are formed in the shape of a valley when seen in cross section. The inks dropped to the tray surfaces 22 flow within the grooves 25 toward the center groove 21.

Figure 21:
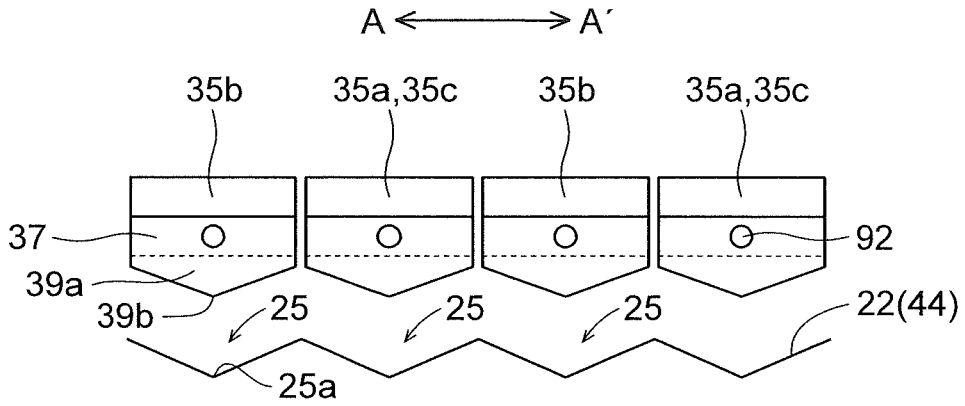
FIG. 21 is a diagram showing a structure in the vicinity of wipers and a tray surface in the wipe unit in the embodiment of the present disclosure.

As shown in FIG. 21, the grooves 25 are provided so as to correspond to the wipers 35*a* to 35*c*. Each of the grooves 25 is formed with a pair of inclined surfaces, and the deepest portion 25*a* of the groove 25 is arranged opposite the lowest end 39*b* of the ink drop portion 39*a*. When seen in the wiping direction (the direction of the arrow B), the pitch of the grooves 25 is equal to the pitch of the wipers 35*a* to 35*c*. In FIG. 21, for ease of understanding, the wiper carriage 31 is omitted.

The restoration operation on the recording heads 17*a* to 17*c* in the printer 100 of the present embodiment will then be described. The restoration operation and the capping operation which will be described below are performed by using the control signals from the control portion 110 (see FIG. 1) so as to control the operations of the recording heads 17*a* to 17*c*, the wipe unit 19, the unit raising/lowering mechanism 60, the unit horizontal movement mechanism 85, the transport raising/lowering mechanism, the drive sources and the like.

When the restoration operation is performed with the wipe unit 19 on the recording heads 17*a* to 17*c*, as shown in FIG. 7, the first transport unit 5 which is arranged opposite the lower surface of the recording portion 9 (see FIG. 1) is lowered from the state of FIG. 6. Here, the wipe unit 19 is arranged in the first height position, and the wipe unit 19 and the cap unit 50 are not coupled to each other.

Then, as shown in FIG. 11, in a state where the cap unit 50 is left in the second position, the carriage 80 is horizontally moved from the second position to the first position, and thus the wipe unit 19 is horizontally moved in the first height position from the second position to the first position.

Then, with the unit raising/lowering mechanism 60, as shown in FIG. 12, the wipe unit 19 is raised. In this way, the wipers 35*a* to 35*c* of the wipe unit 19 are pressed to the wiping start positions of the ink discharge surfaces F of the recording heads 17*a* to 17*c*.

Then, before the wiping operation, the inks are supplied to the recording heads 17*a* to 17*c*. The supplied inks are forcefully pushed out (purged) from the ink discharge ports 18 (see FIG. 2). By this purge operation, the inks whose viscosities are increased, foreign substances and air bubbles within the ink discharge ports 18 are discharged. Here, the purge inks are pushed out to the ink discharge surfaces F along the shapes of the ink discharge regions R (see FIG. 5) where the ink discharge ports 18 are present.

Thereafter, the wiping operation for wiping off the inks (purge inks) pushed out to the ink discharge surfaces F is performed. Specifically, the wiper carriage movement motor 45 is rotated forward from the state shown in FIG. 12, and thus as shown in FIG. 13, the wiper carriage 31 is horizontally moved in the direction of the arrow B, with the result that the inks pushed out to the ink discharge surfaces F of the recording heads 17*a* to 17*c* are wiped off with the wipers 35*a* to 35*c*. The waste inks wiped off with the wipers 35*a* to 35*c* are recovered in the recovery tray 44 arranged within the wipe unit 19. Here, the waste inks wiped off with the wipers 35*a* to 35*c* are moved to the wiper fixing members 37 along the surfaces (the surfaces in the direction of the arrow B) of the wipers 35*a* to 35*c* on the downstream side in the wiping direction, and are dropped to the recovery tray 44 from the lowest ends 39*b* of the lower end portions (the ink drop portions 39*a*) of the wiper fixing members 37.

Thereafter, with the unit raising/lowering mechanism 60 (see FIG. 14), as shown in FIG. 11, the wipe unit 19 is lowered to the first height position, and thus the wipers 35*a* to 35*c* are separated downward from the ink discharge surfaces F of the recording heads 17*a* to 17*c*. Then, the wiper carriage 31 is moved in a direction opposite to the wiping direction (the direction of the arrow B'), and thus the wipe unit 19 is returned to the original state.

Then, the carriage 80 and the wipe unit 19 arranged in the first position are horizontally moved from the first position to the second position. In this way, the wipe unit 19 is arranged below the cap unit 50. Then, the restoration operation on the recording heads 17*a* to 17*c* is completed.

The inks dropped to the tray surfaces 22 of the recovery tray 44 flow within the grooves 25 of the tray surfaces 22 toward the center groove 21, and thereafter the inks flows within the center groove 21 toward the discharge port 23. Then, the inks are passed through the discharge tube so as to be stored in the waste ink tank (both of which are not illustrated).

The operation (capping operation) of fitting the cap unit 50 to the recording heads 17*a* to 17*c* in the printer 100 of the present embodiment will then be described.

When the recording heads 17*a* to 17*c* are capped with the cap unit 50, as shown in FIG. 7, the first transport unit 5 which is arranged opposite the lower surface of the recording portion 9 (see FIG. 1) is lowered from the state of FIG. 6. Here, the wipe unit 19 is arranged in the first height position, and thus the wipe unit 19 and the cap unit 50 are not coupled to each other.

Then, with the unit raising/lowering mechanism 60 (see FIG. 14), the wipe unit 19 is raised from the first height position to the second height position. In this way, as shown in FIG. 16, the coupling pins 42 are inserted into the coupling holes 52*a*, and thus the wipe unit 19 and the cap unit 50 are coupled to each other.

Thereafter, as shown in FIG. 8, the carriage 80 is horizontally moved from the second position to the first position, and thus the cap unit 50 is horizontally moved from the second position to the first position in a state where the cap unit 50 is coupled to the upper surface of the wipe unit 19.

Then, with the unit raising/lowering mechanism 60, as shown in FIG. 9, the wipe unit 19 and the cap unit 50 are raised. When the cap portions 53 of the cap unit 50 are brought into intimate contact with the ink discharge surfaces F of the recording heads 17*a* to 17*c*, the rotation of the winding drive motor 64 (see FIG. 14) is stopped, and thus the capping of the recording heads 17*a* to 17*c* with the cap unit 50 is completed.

In the present embodiment, as described above, the ink drop portion 39*a* which drops the inks wiped off with the wipers 35*a* to 35*c* to the tray surfaces 22 is formed such that the length thereof in the width direction (the direction of the arrows A and A') orthogonal to the wiping direction is reduced as the ink drop portion 39*a* is extended downward. In this way, when the inks pushed out to the ink discharge surfaces F are wiped off with the wipers 35*a* to 35*c*, the inks flow to the ink drop portions 39*a* along the wipers 35*a* to 35*c*, and thus the inks are dropped from the ink drop portions 39*a* to the tray surfaces 22. Here, since the ink drop portion 39*a* is formed such that the length in the width direction (the direction of the arrows A and A') is reduced as the ink drop portion 39*a* is extended downward, the inks are dropped to the tray surfaces 22 in a state where the inks are collected in the direction of the arrows A and A'. Hence, the inks dropped to the tray surfaces 22 easily flow, and thus it is possible to reduce the solidification of the ink at that place. Consequently, the inks can easily be collected.

As described above, in the tray surfaces 22, the grooves 25 are provided which are extended along the wiping direction, which are formed in the shape of a valley when seen in cross section and through which the recovered inks flow. In this way, it is possible to more easily collect the inks dropped to the tray surfaces 22.

As described above, the deepest portion 25*a* of the groove 25 is arranged opposite the lowest end 39*b* of the ink drop portion 39*a*. In this way, the inks dropped from the ink drop portions 39*a* are directly dropped to the deepest portions 25*a* of the grooves 25 so as to more easily flow within he grooves 25 along the wiping direction.

As described above, the wiper fixing members 37 are arranged on the downstream side in the wiping direction with respect to the wipers 35*a* to 35*c*, and the ink drop portions 39*a* are provided in the wiper fixing members 37. In this way, the inks wiped off with the wipers 35*a* to 35*c* are moved from the wipers 35*a* to 35*c* to the wiper fixing members 37 and are dropped from the lower end portions (the ink drop portions 39*a*) of the wiper fixing members 37. Hence, the inks wiped off with the wipers 35*a* to 35*c* can be smoothly dropped from the ink drop portions 39*a*.

As described above, the ink drop portion 39*a* is formed in the shape of an inverted triangle. In this way, the inks wiped off with the wipers 35*a* to 35*c* are dropped to the tray surfaces 22 in a state where the inks are collected in one point (the lowest end 39*b*) in the width direction, and thus the inks dropped to the tray surfaces 22 more easily flow.

As described above, the wipers 35*a* to 35*c* are fixed with the wiper fixing members 37 to the fixing auxiliary members 38. In this way, it is possible to reduce variations in the height of attachment of the wipers 35*a* to 35*c* and the angle of attachment thereof. When the fixing auxiliary members 38 are not provided, the wiper carriage 31 is bent and the wipers 35*a* to 35*c* are fixed to the bent portion, variations in the height of attachment of the wipers 35*a* to 35*c*, the angle of attachment thereof and the like may be produced due to a variation in the bending processing of the wiper carriage 31.

As described above, the end edge (lower surface, lower end edge) of the ink drop portion 39*a* which is extended in the direction of the arrows A and A' is inclined with respect to the direction of the arrows A and A' at an angle which is equal to or more than 10 degrees but equal to or less than 30 degrees. In this way, while an increase in the dimension of the ink drop portion 39*a* in the up/down direction is being reduced, the inks can easily be collected in the ink drop portion 39*a* in the direction of the arrows A and A'.

It should be considered that the embodiment disclosed herein is illustrative in all respects and not restrictive. The scope of the present disclosure is indicated not by the description of the embodiment discussed above but by the scope of claims, and furthermore, meanings equivalent to the scope of claims and all modifications within the scope are included.

For example, although in the embodiment discussed above, the example where only the inks (purge inks) are used so as to perform the restoration operation on the recording heads 17*a* to 17*c* is described, the inks and a cleaning liquid may be used so as to perform the restoration operation on the recording heads 17*a* to 17*c*.

Although in the embodiment discussed above, the example where the grooves 25 which are formed in the shape of a valley when seen in cross section are formed in the tray surfaces 22 is described, the present disclosure is not limited to this example, and the grooves 25 do not need to be formed in the tray surfaces 22.

Although in the embodiment discussed above, the example where the tray surfaces 22 are inclined downward toward the center groove 21, that is, the example where the tray surfaces 22 are inclined along the direction of the arrows B and B' is described, the present disclosure is not limited to this example, and the tray surfaces 22 may be inclined along the direction of the arrows A and A'.

Although in the embodiment discussed above, the example where the deepest portion 25*a* of the groove 25 is arranged opposite the lowest end 39*b* of the ink drop portion 39*a* is described, the present disclosure is not limited to this example. The deepest portion 25*a* of the groove 25 and the lowest end 39*b* of the ink drop portion 39*a* may be arranged in positions displaced from each other in the direction of the arrows A and A'.

Figure 22:
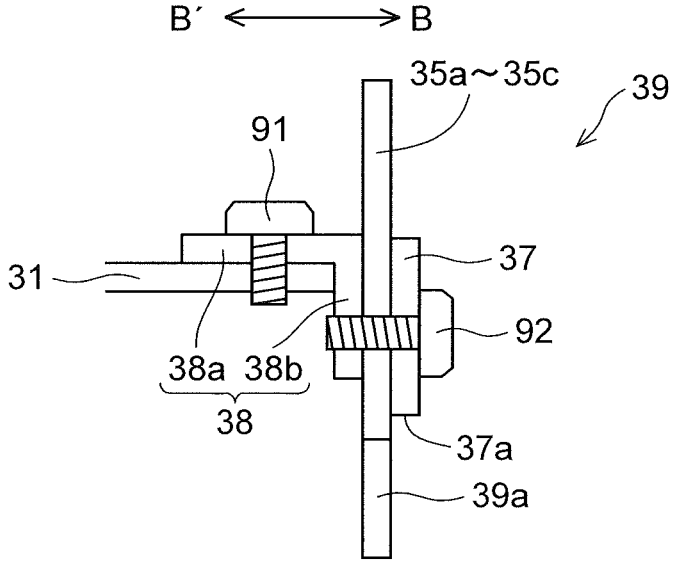
FIG. 22 is a diagram showing a structure of a wiping portion in a wipe unit in a first variation of the present disclosure.

Although in the embodiment discussed above, the example where the lower end portion of the wiper fixing member 37 is the ink drop portion 39*a* is described, the present disclosure is not limited to this example. For example, as the wipe unit 19 of a first variation of the present disclosure shown in FIG. 22, the wipers 35*a* to 35*c* may be formed downward beyond the lower ends 37*a* of the wiper fixing members 37 such that the lower end portions of the wipers 35*a* to 35*c* are used as the ink drop portions 39*a*. In this case, the inks wiped off with the wipers 35*a* to 35*c* are moved to the wiper fixing members 37 along the wipers 35*a* to 35*c*, are further moved to the wipers 35*a* to 35*c* along the wiper fixing members 37 and are dropped from the lower end portions (the ink drop portions 39*a*) of the wipers 35*a* to 35*c*. The vertical portion 38*b* of the fixing auxiliary member 38 is formed to be longer, and thus the lower end portion of the vertical portion 38*b* can be used as the ink drop portion 39*a*.

Figure 23:
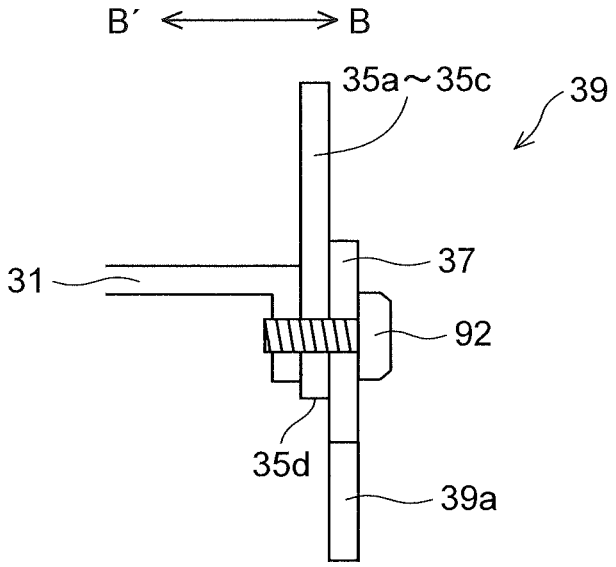
FIG. 23 is a diagram showing a structure of a wiping portion in a wipe unit in a second variation of the present disclosure.

Although in the embodiment discussed above, the example where the wiping portions 39 are formed with the wipers 35*a* to 35*c*, the wiper fixing members 37 and the fixing auxiliary members 38 is described, the present disclosure is not limited to this example. For example, as the wipe unit 19 of a second variation of the present disclosure shown in FIG. 23, the wiping portions 39 may be formed with the wipers 35*a* to 35*c* and the wiper fixing members 37 without provision of the fixing auxiliary members 38. Preferably, in this case, the wiper carriage 31 is bent vertically, and the wipers 35*a* to 35*c* are fixed to the bent portion.

Figure 24:
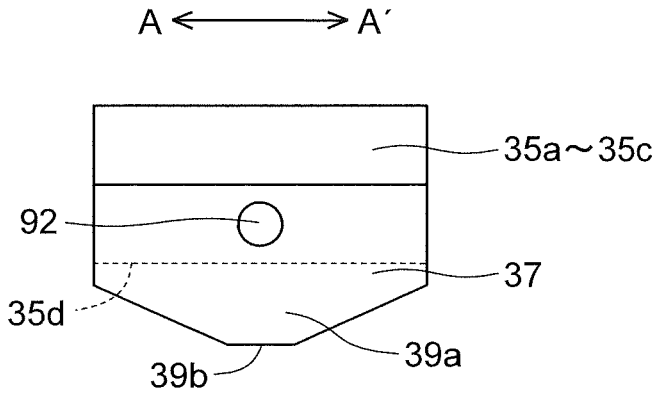
FIG. 24 is a diagram showing a structure of a wiper and a wiper fixing member in a wipe unit in a third variation of the present disclosure.

Although in the embodiment discussed above, the example where the ink drop portion 39*a* is formed in the shape of an inverted triangle is described, the present disclosure is not limited to this example. For example, as the wipe unit 19 of a third variation of the present disclosure shown in FIG. 24, the ink drop portion 39*a* may be formed in the shape of an inverted trapezoid.

Configurations which are obtained by combining, as necessary, the configurations of the embodiment and the variations described above are also included in the technical scope of the present disclosure.

What is claimed is:

1. A wipe unit which cleans a recording head including an ink discharge surface in which an ink discharge port for discharging an ink on a recording medium is opened, the wipe unit comprising:

a wiper which wipes off the ink that is forcefully pushed out from the ink discharge port;

a wiper carriage which is moved along a wiping direction in a state where the wiper is held;

a wiper fixing member which fixes the wiper to the wiper carriage; and a recovery tray which is arranged below the wiper and which includes a tray surface that recovers the ink wiped off with the wiper, wherein the tray surface is inclined with respect to a horizontal plane, and makes the recovered ink flow in a predetermined direction so as to collect the recovered ink, a wiping portion is formed with the wiper and the wiper fixing member, the wiping portion includes an ink drop portion which drops the ink wiped off with the wiper to the tray surface and the ink drop portion is formed such that a length thereof in a width direction orthogonal to the wiping direction is reduced as the ink drop portion is extended downward.

2. The wipe unit according to claim 1, wherein the tray surface is inclined along the wiping direction, and in the tray surface, a groove is provided which is extended along the wiping direction, which is formed in a shape of a valley when seen in cross section and through which the recovered ink flows.

3. The wipe unit according to claim 2, wherein a deepest portion of the groove is arranged opposite a lowest end of the ink drop portion.

4. The wipe unit according to claim 3, wherein a plurality of the wipers are provided, a plurality of the grooves are provided and when seen in the wiping direction, a pitch of the grooves is equal to a pitch of the wipers.

5. The wipe unit according to claim 1, wherein the wiper fixing member is arranged on a downstream side in the wiping direction with respect to the wiper, and the ink drop portion is provided in the wiper fixing member.

6. The wipe unit according to claim 1, wherein the ink drop portion is formed in a shape of an inverted triangle.

7. The wipe unit according to claim 1, wherein the wiping portion includes a fixing auxiliary member which is fixed to the wiper carriage, and the wiper is fixed with the wiper fixing member to the fixing auxiliary member.

8. The wipe unit according to claim 1, wherein an end edge of the ink drop portion in the width direction is inclined with respect to the width direction at an angle which is equal to or more than 10 degrees but equal to or less than 30 degrees.

9. An inkjet recording device comprising:

the wipe unit according to claim 1; and the recording head which discharges the ink on the recording medium.

* * * * *